US008505419B2

(12) United States Patent
Cheng

(10) Patent No.: US 8,505,419 B2
(45) Date of Patent: Aug. 13, 2013

(54) WRENCH WITH ROTATABLE DRIVING HEAD

(76) Inventor: Chin-Shun Cheng, Taichung (TW)

( * ) Notice: Subject to any disclaimer, the term of this patent is extended or adjusted under 35 U.S.C. 154(b) by 387 days.

(21) Appl. No.: 13/075,179

(22) Filed: Mar. 30, 2011

(65) Prior Publication Data

US 2012/0247280 A1 Oct. 4, 2012

(51) Int. Cl.
*B25B 23/16* (2006.01)

(52) U.S. Cl.
USPC ..... 81/177.8; 81/177.1; 81/177.7; 81/177.75; 81/177.85

(58) Field of Classification Search
USPC ..... 81/177.1, 177.7, 177.75, 177.85, 81/177.8
See application file for complete search history.

(56) References Cited

U.S. PATENT DOCUMENTS 7,987,746 B2 * 8/2011 Chiang ..... 81/58.3
8,375,829 B2 * 2/2013 Lin ..... 81/58.1

* cited by examiner

*Primary Examiner* — Lee D Wilson
*Assistant Examiner* — Shantese McDonald

(57) ABSTRACT

A wrench includes a body and a driving head connected to the body. The body includes a push rod, two first push pieces, two second push pieces and a push unit so as to control the position and angle that the driving head rotates relative to the body. The driving head includes multiple positioning holes, an engaging protrusion, a through hole in the engaging protrusion, a bead and a control rod to control the engagement or disengagement between the engaging protrusion and the socket.

9 Claims, 14 Drawing Sheets

WRENCH WITH ROTATABLE DRIVING HEAD

FIELD OF THE INVENTION

The present invention relates to a wrench, and more particularly, to a wrench with rotatable driving head which is rotatable 360 degrees relative to the handle.

BACKGROUND OF THE INVENTION

A conventional wrench with rotatable driving head is disclosed in U.S. Pat. No. 2,977,824 and generally includes a body with a groove defined axially therein so as to form two parts and a positioning pin is connected between the two parts to prevent the two parts from overly separated from each other. A driving head is pivotably connected between the two parts. The wrench has at least two disadvantages, one of which is that when the driving head is rotated, the driving head cannot be rotated 360 degrees especially when a socket is connected to the driving head. The other disadvantage is that the driving head is not well positioned so that it is not stable when operation.

The present invention intends to provide a wrench having a driving head that is rotatable 360 degrees relative to the handle.

SUMMARY OF THE INVENTION

The present invention relates to a wrench with a driving head that is able to rotate 360 degrees and has three different operation modes. The wrench comprises a body and a driving head connected to the body. The body includes a push rod, two first push pieces, two second push pieces and a push unit so as to control the position and angle that the driving head rotates relative to the body. The driving head includes multiple positioning holes, an engaging protrusion, a through hole in the engaging protrusion, a bead and a control rod to control the engagement or disengagement between the engaging protrusion and the socket.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
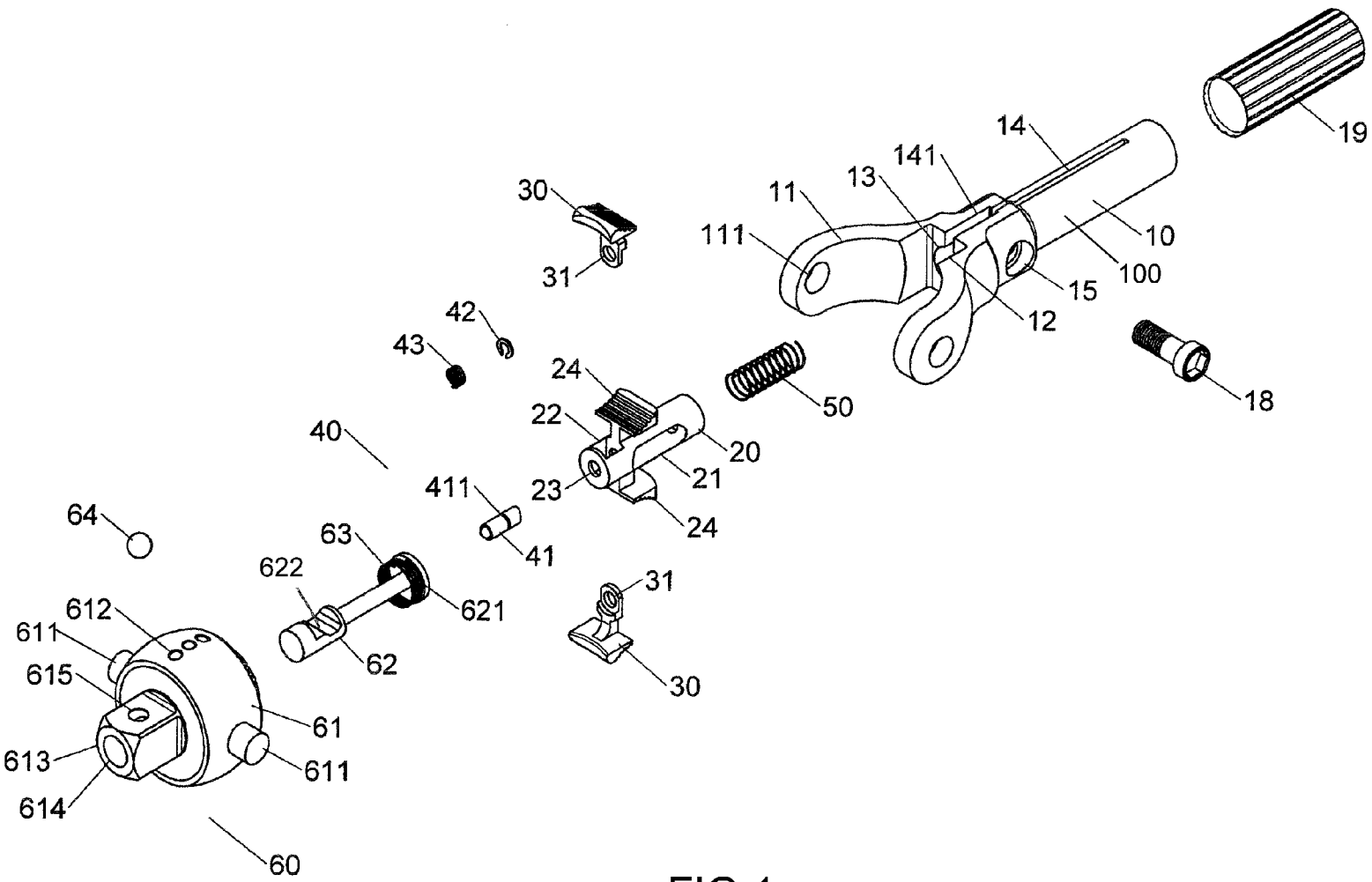
FIG. 1 is an exploded view to show the wrench of the present invention.

Referring to FIGS. 1 to 4, the wrench of the present invention comprises a body 10 having a Y-shaped arm 11 connected to the first end thereof and a handle 100 extends from the second end of the body 10. Each of the two ends of the Y-shaped arm 11 has a pivotal hole 111. A recessed area 12 is defined in the inner end of the Y-shaped arm 11 and a recess 13 is defined in the inner end of the recessed area 12. A slit 141 is defined in the body 10 and communicates with and a slot 14 defined in the handle and co-axially communicates with the slit 141. A width of the slit 141 is larger than that of the slot 14. A locking hole 15 is defined transversely through the body 10 and communicates with the recess 13.

A push member 20 is located in the recess 13 and has a guide hole 21 defined in the mediate portion thereof 20. The push member 20 has an axial hole 23 defined in the first end thereof and a radial hole 22 is defined in the outer surface of the push member 20 and located close to the first end. The guide hole 21 is located corresponding to the locking hole 15 and the radial hole 22 is located corresponding to the slit 141. The guide hole 21 does not communicate with the radial hole 22. The axial hole 23 communicates with the radial hole 22 and the guide hole 21. The axial hole 23 and the recess 13 open in the same direction. The second end of the push member 20 is inserted into the axial hole 23. The push member 20 has two first push pieces 24 and each push piece 24 having an extension inserted into the slit 141 and a distal portion extends out from the slit 141.

At least one second piece 30, in this embodiment, there are two second push pieces 30 located corresponding to the two first push pieces 24. Each second piece 30 has a connection ring 31 inserted into the radial hole 22 and contacts the inside of the radial hole 22.

A push unit 40 is located in the radial hole 22 and the axial hole 23 of the push member 20.

A push rod 41 is located in the axial hole 23 and the an end of the push rod 41 extends out from the axial hole 23 and through the two respective connection rings 31 to position the second push pieces 30 in the radial hole 22. An annular groove 411 is defined in the outer surface of the push rod 41.

A clip 42 is engaged with the annular groove 411. An outer diameter of the clip 42 is larger than a diameter of the axial hole 23 of the push member 20 to restrict the push rod 41 from dropping from the axial hole 23. The clip 42 contacts the second push pieces 30. A first spring 43 is mounted the push rod 41 and biased between the clip 42 and an inside of the radial hole 22.

The second push pieces 30, the push rod 41, the clip 42 and the first spring 43 are connected to the push member 20. The first spring 43 pushes the second push pieces 30 to contact against the inside of the radial hole 22 and push the second push pieces 30 to overcome the force of the first spring 43. The two second push pieces 30 push the push rod 41 which further extends out from the axial hole 23.

A spring member 50 is located in the recess 13 and biased between the inside of the recess 13 and the push member 20, so that the push member 20 is resiliently movable in the body 10. The push member 20, the second push pieces 30 and the push unit 40 are biased by the spring member 50, the push member 20, the second push pieces 30 and the push unit 40 seal the recessed area 12.

A positioning pin 18 has outer threads and extends through the locking hole 15 and the guide hole 21 to restrict the push member 20 to be only moved within a range in the recess 13 and to prevent the base portion of the Y-shaped arm 11 from splitting apart.

A sleeve 19 is mounted to the handle 100 to seal the slot 14.

A driving head 60 includes a cylindrical body 61 which is pivotably connected to the Y-shaped arm 11 by two pivots 611 and can be operated in both clock and counter clockwise directions. Multiple positioning holes 612 are defined in the outer surface of the driving head 60. Each positioning hole 612 has an axis that perpendicularly extends the axes of the pivots 611. The push rod 41 is engaged with one of the positioning holes 612.

An engaging protrusion 613 extends from one end of driving head 60 and the engaging protrusion 613 is a rectangular protrusion so as to be connected with a socket. When the driving head 60 is rotated relative to the Y-shaped arm 11, the engaging protrusion 613 passes through the recessed area 12. The engaging protrusion 613 has a through hole 614 defined axially therethrough and a reception hole 615 defined radially in the driving engaging protrusion 613 and communicating with the through hole 614. A bead 64 is engaged with the reception hole 615. A control rod 62 is located in the through hole 614 and has a stepped recess 622 defined radially in the first end thereof. The stepped recess 622 is located corresponding to the reception hole 615 of the engaging protrusion 613. A notch 621 is defined in the second end of the control rod 62 and the push rod 41 is engaged with the notch 621. Two open ends of the through hole 614 are larger than a mediate portion of the through hole 614.

A second spring 63 is mounted to the control rod 62 to provide a force to move the control rod 62 in the through hole 614. The bead 64 is engaged with the stepped recess 622 and movable within the reception hole 615 along with a movement of the control rod 62.

Figure 2:
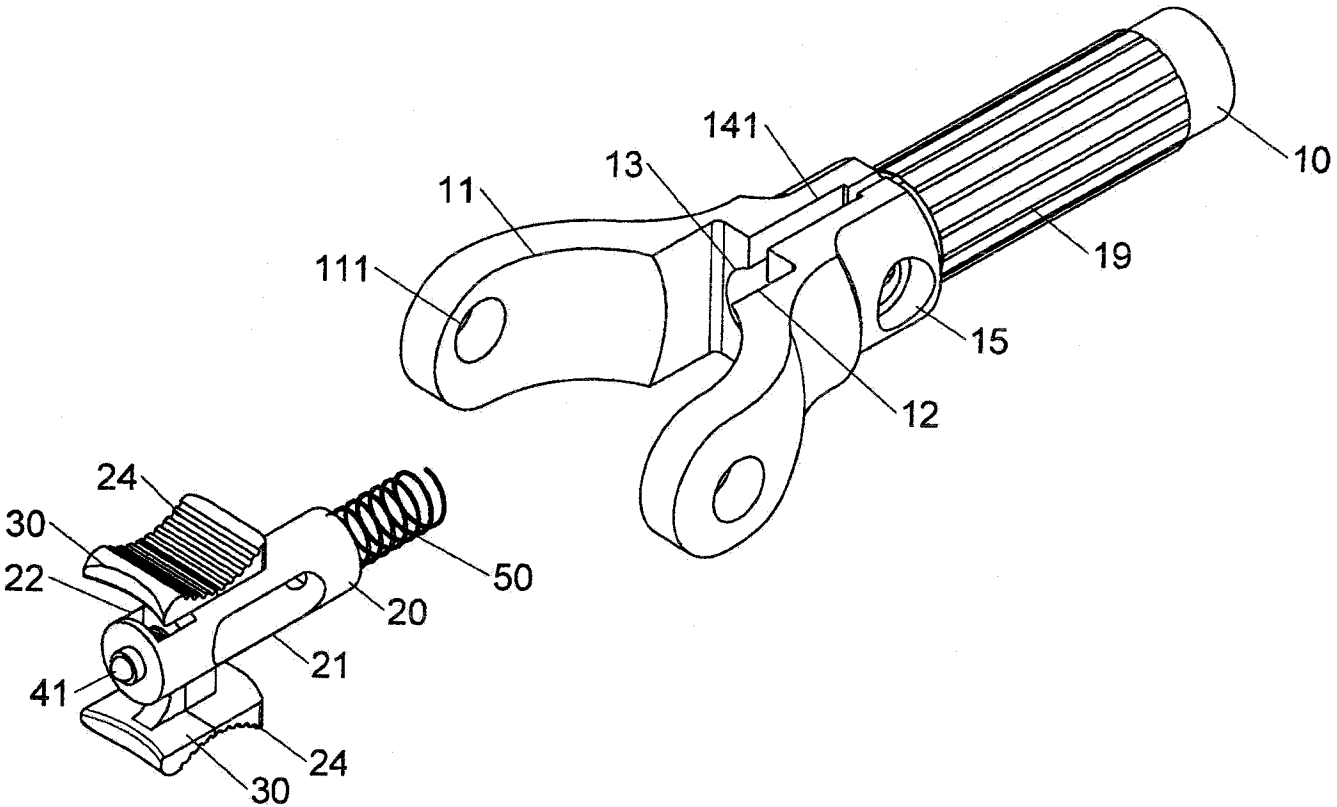
FIG. 2 is an exploded view to show the body and the push member of the wrench of the present invention.
Figure 4:
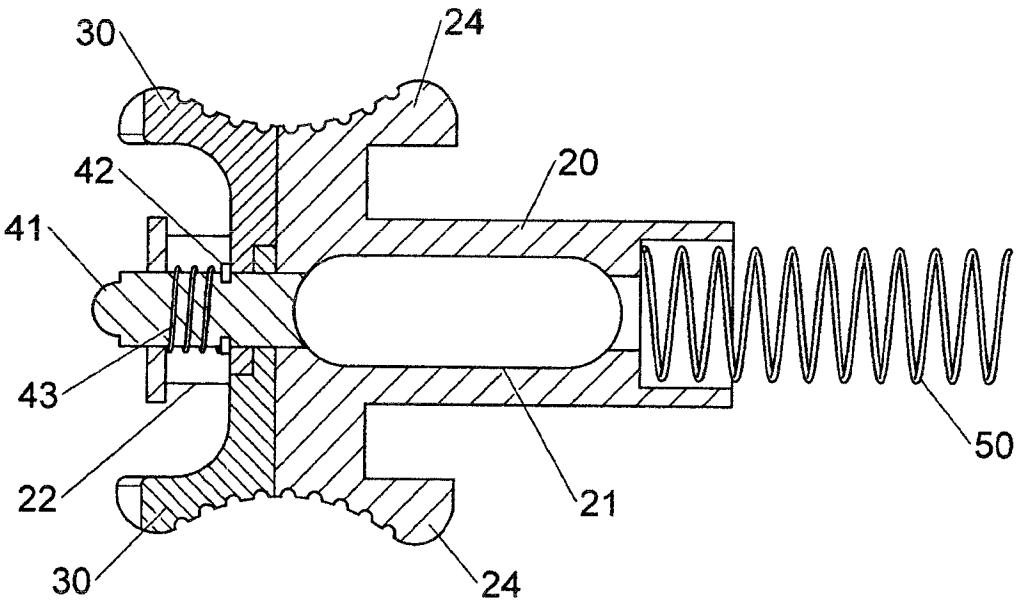
FIG. 4 is a cross sectional view, taken along line A-A in FIG. 3.
Figure 3:
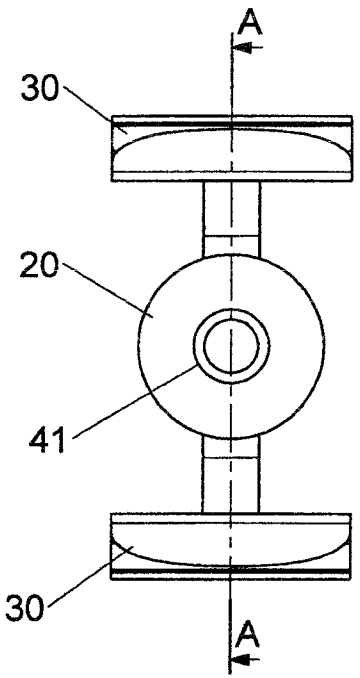
FIG. 3 is a front view of the push member of the wrench of the present invention.

As shown in FIG. 2, the two connection rings 31 of the two second push pieces 30 are located in the radial hole 22 and the push rod 41 is inserted into the axial hole 23 and extends through the first spring 43 and the clip 42 is mounted to the push rod 41. The push rod 41 extends through the connection rings 31 and an end of the push rod 41 extends out from the axial hole 23, and the two second push pieces 30 and the push unit 40 are connected to the push member 20.

Figure 5:
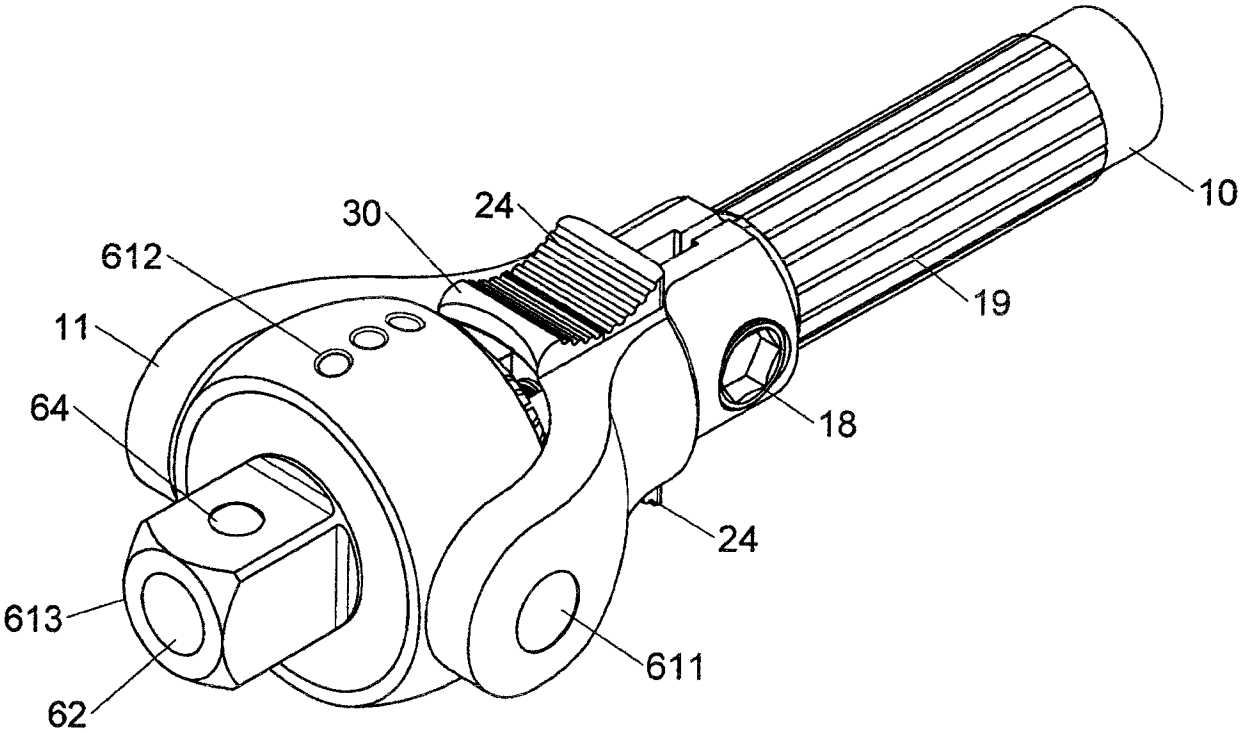
FIG. 5 is a perspective view to show the wrench of the present invention.
Figure 6:
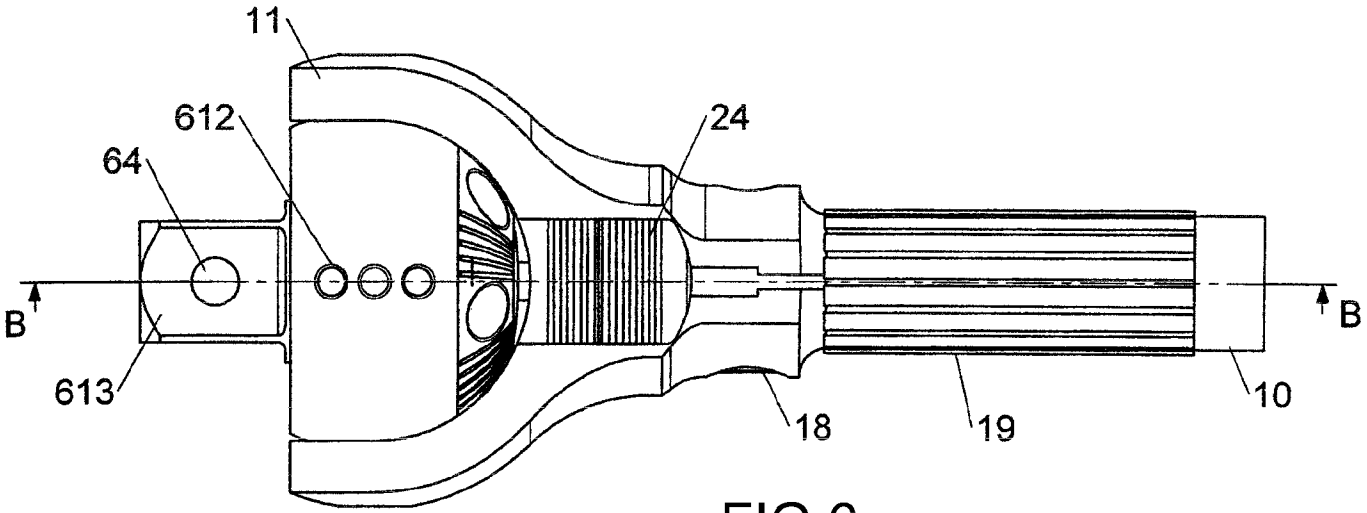
FIG. 6 shows the top view of the wrench of the present invention.
Figure 7:
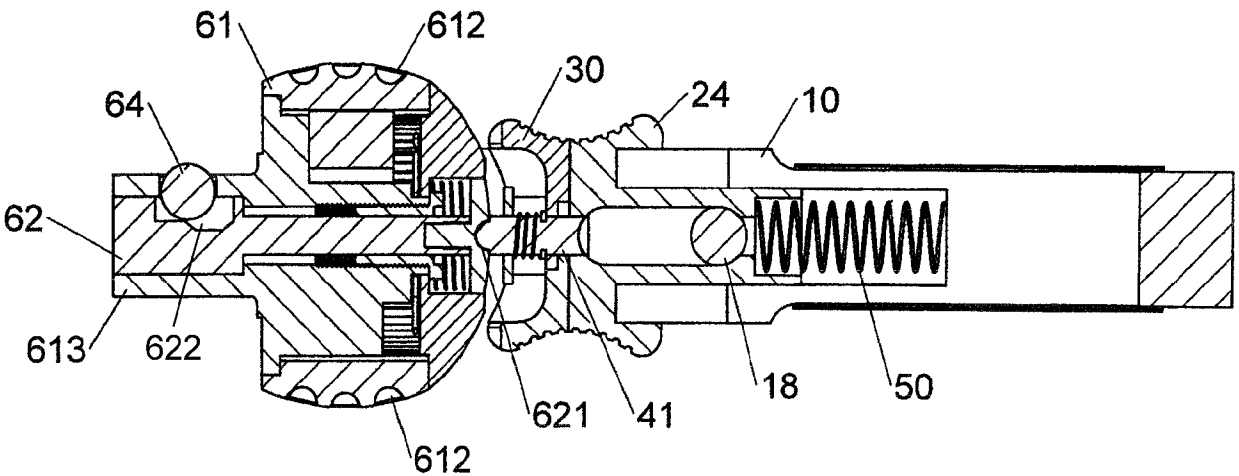
FIG. 7 shows a cross sectional view, taken along line B-B in FIG. 6.

As shown in FIGS. 5 to 7, the spring member 50 is located in the recess 13, and the push member 20, the two second push pieces 30 and the push unit 40 are located in the recess 13. Each of the first and second push pieces 30, 40 has a portion exposed out from the slit 141 so that the user can push them. The positioning pin 18 extends through the locking hole 15 and the guide hole 21 to position the push member 20 to the body 10. The sleeve 19 is mounted to the body 10 and seals the slot 14. The driving head 60 is pivotably connected to the Y-shaped arm 11 and the push rod 41 is engaged with the notch 621. The control rod 62 is pushed by the second spring 63 and the shallower portion of the stepped recess 622 is located corresponding to the reception hole 615 so that the bead 64 partially protrudes from the reception hole 615 to position the socket.

Figure 8:
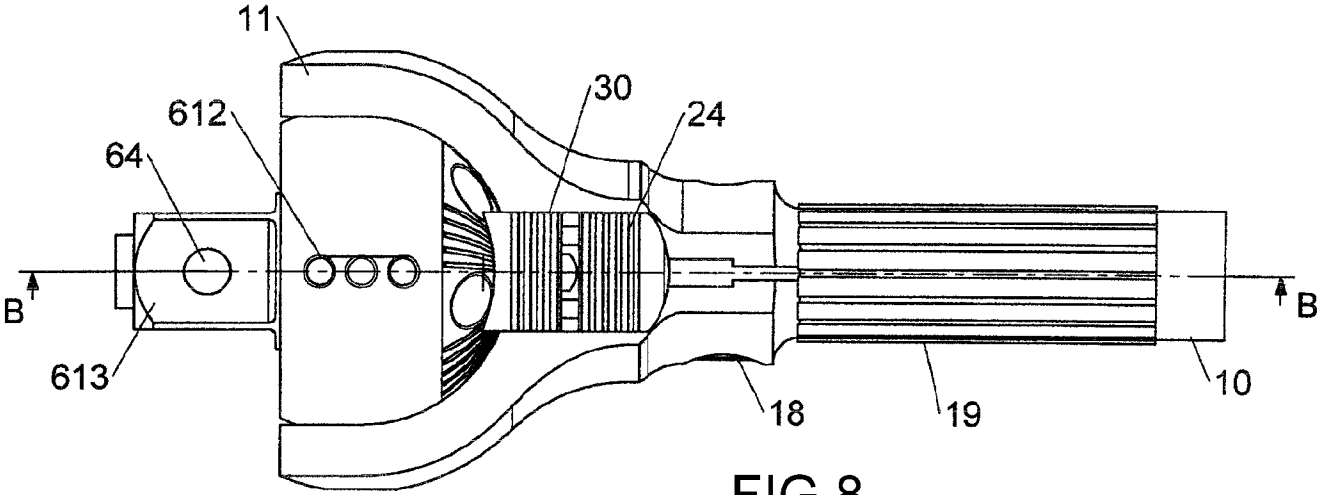
FIG. 8 shows the first operation position of the wrench of the present invention.
Figure 9:
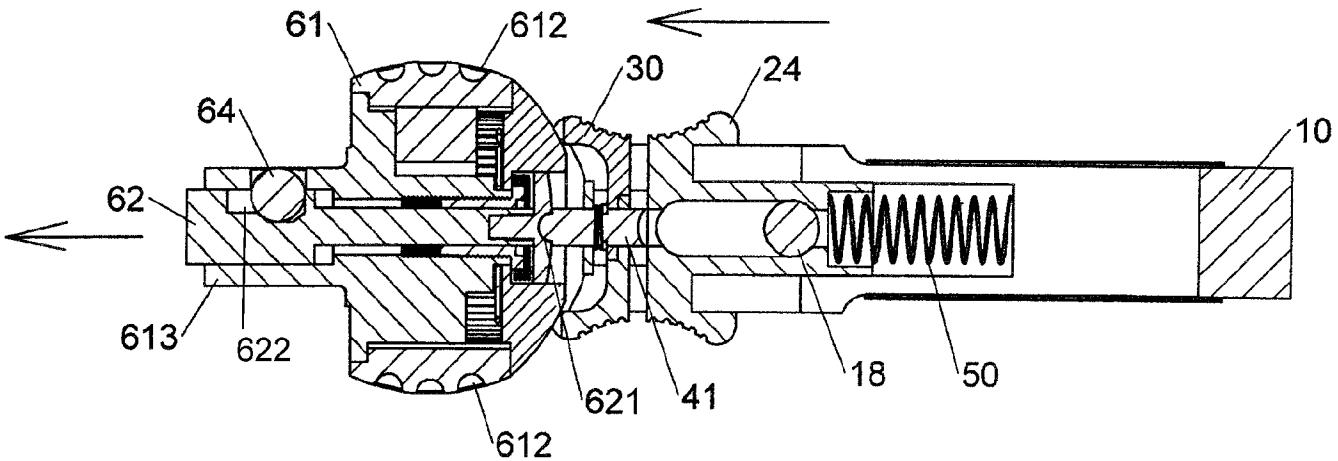
FIG. 9 shows a cross sectional view, taken along line B-B in FIG. 8.

As shown in FIGS. 8 and 9, when the user pushes the second push pieces 30 toward the Y-shaped arm 11, the push rod 41 compresses the first spring 43 and is engaged with the notch 621 of the control rod 62. The control rod 62 is moved to compress the second spring 63 and the deeper portion of the stepped recess 622 is located to corresponding to the reception hole 615, so that the bead 64 is retracted into the reception hole 615 and the socket can be removed from the engaging protrusion 613.

Figure 10:
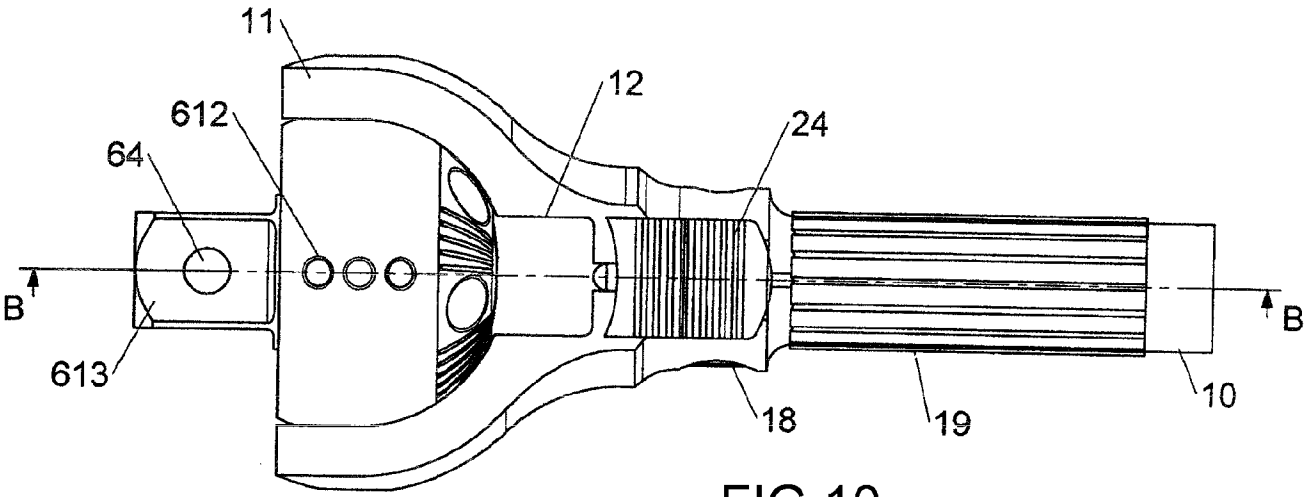
FIG. 10 shows the second operation position of the wrench of the present invention.
Figure 11:
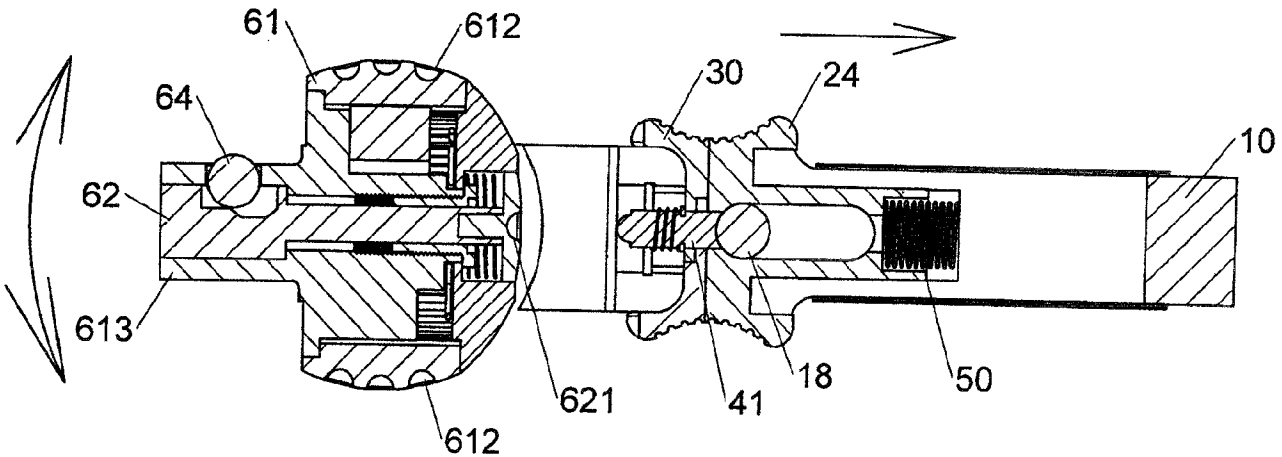
FIG. 11 shows a cross sectional view, taken along line B-B in FIG. 10.

As shown in FIGS. 10 and 11, when the user pushes the first push pieces 24 or the second push pieces 30 toward the handle 100 on the body 20 to a significant distance, the push member 20 compresses the spring member 50 and the push rod 41 is removed from the notch 621. The recessed area 12 of the body 10 is not blocked so that the engaging protrusion 613 can pass through the recessed area 12 and the driving head 60 is able to rotated 360 degrees.

Figure 12:
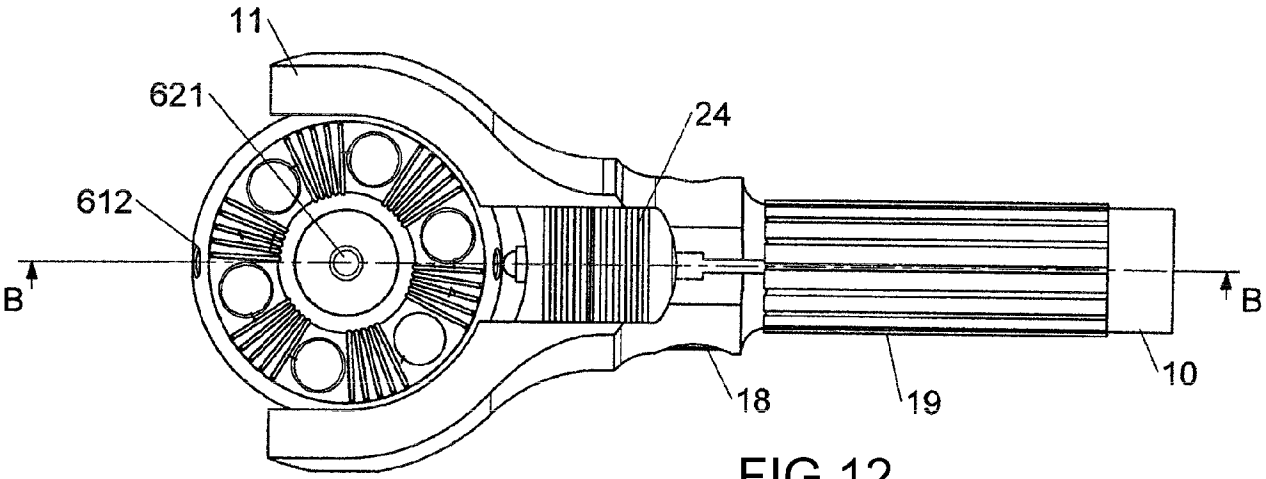
FIG. 12 shows the third operation position of the wrench of the present invention.
Figure 13:
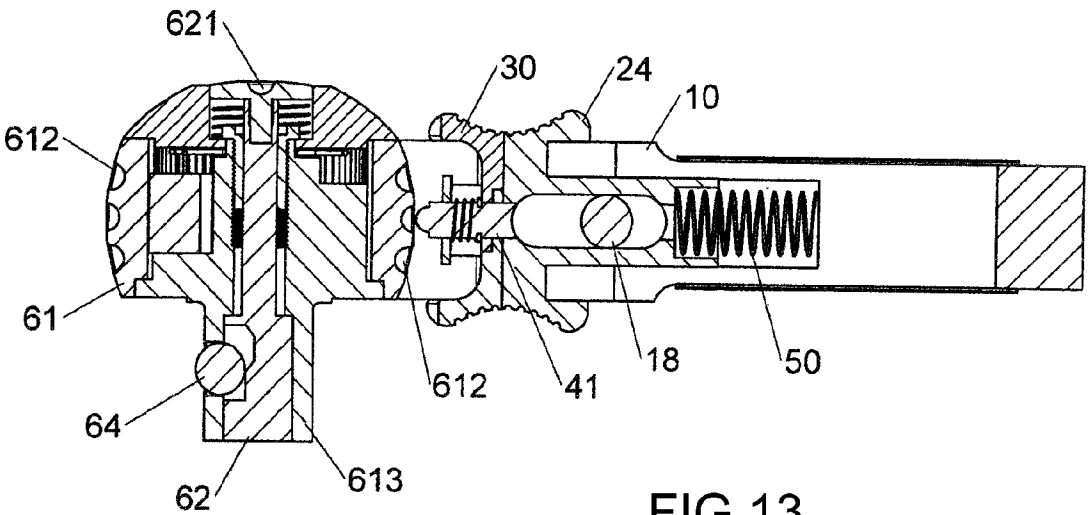
FIG. 13 shows a cross sectional view, taken along line B-B in FIG. 12.

As shown in FIGS. 12 and 13, when the user pushes the first push pieces 24 or the second push pieces 30 toward the handle 100 on the body 20 to a limited distance, the push rod 41 is removed from the notch 621. The driving head 60 is rotated within a limited range on the Y-shaped arm 11. For example, the engaging protrusion 613 is perpendicular to the handle, release the first push pieces 24 or the second push pieces 30, the push rod 41 is engaged with the positioning hole 612, the driving head 60 is securely positioned at an fixed angular position relative to the body 10.

Figure 14:
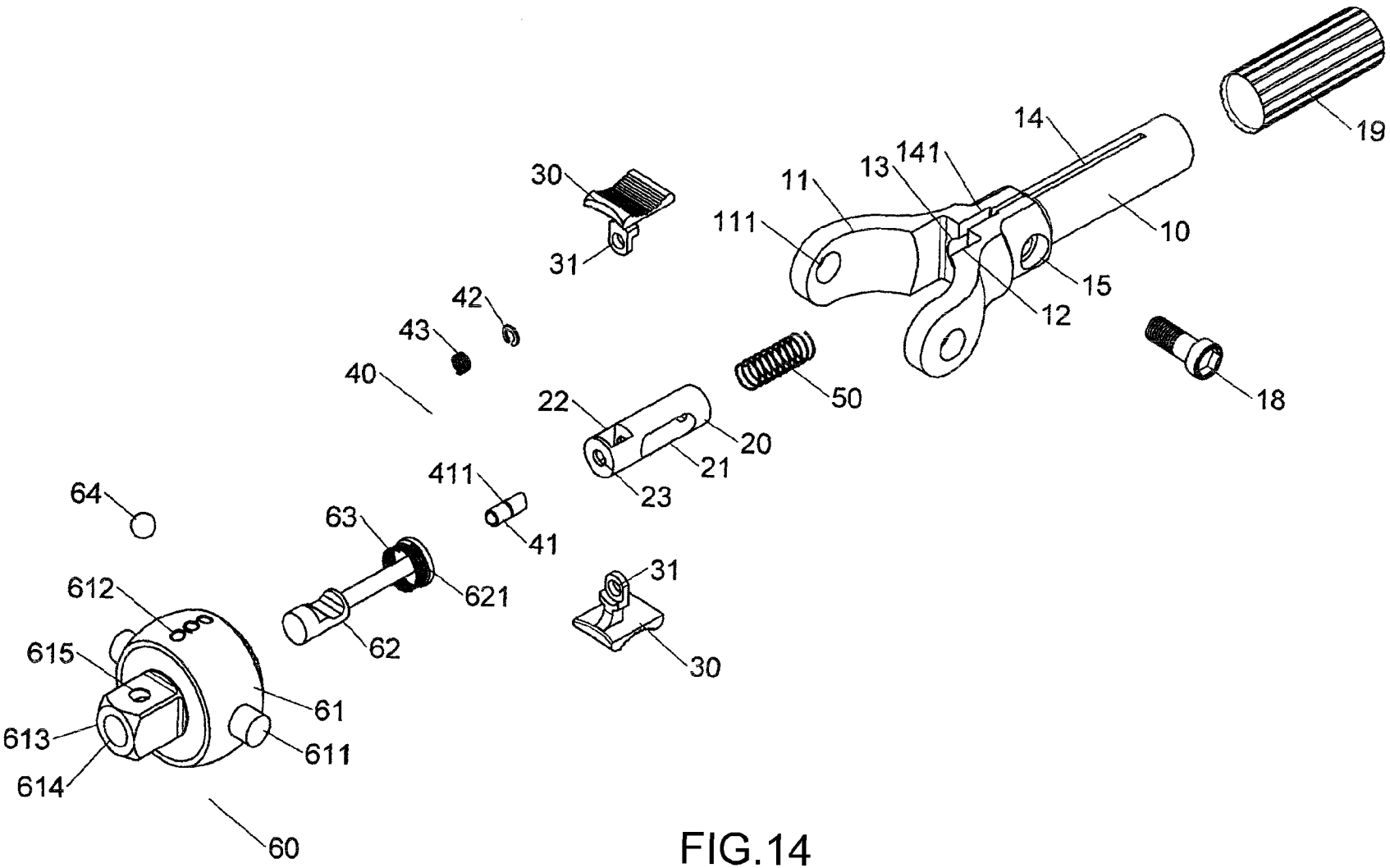
FIG. 14 is an exploded view to show the second embodiment of the wrench of the present invention.

FIG. 14 shows that the push member 20 does not have the first push pieces 24. The push member 20, the second push pieces 30 and the push unit 40 are located in the recess 13. The second push pieces 30 can push to move the push member 20 in the same direction.

Figure 15:
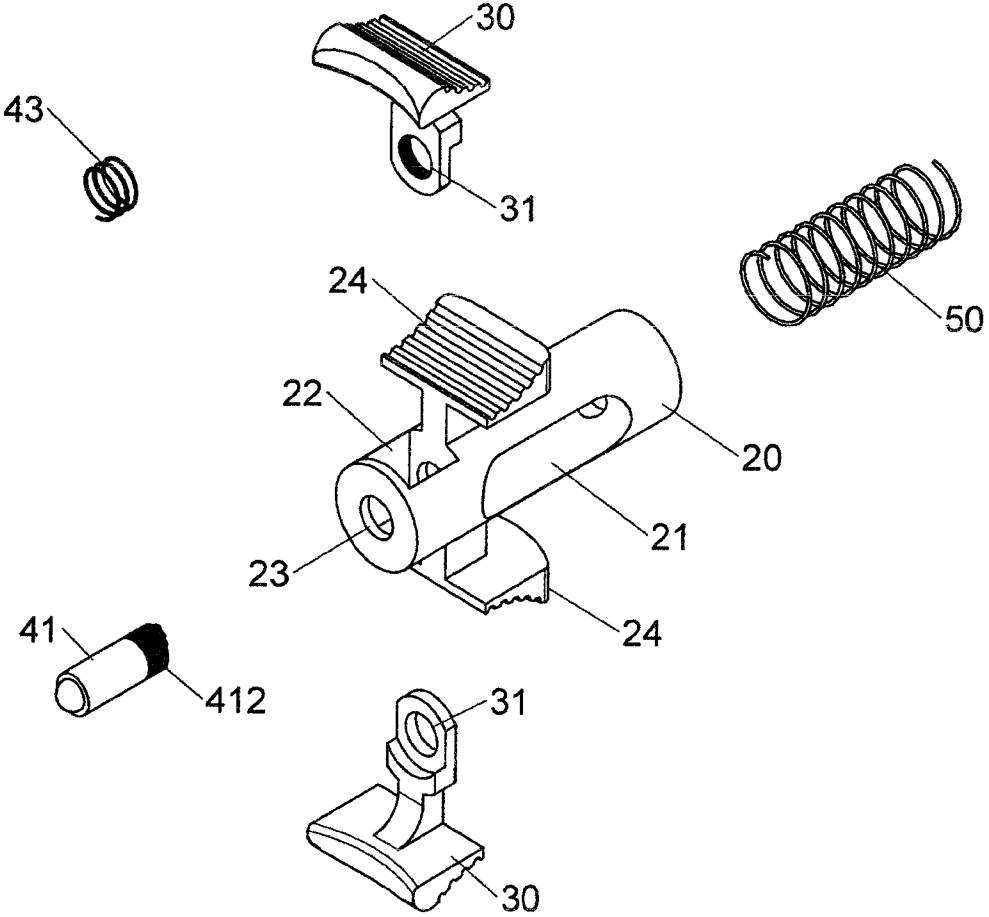
FIG. 15 is an exploded view to show the third embodiment of the wrench of the present invention.

FIG. 15 shows that the connection rings 31 have inner threads and the push rod 41 has a first threaded portion 412 with outer threads. The first threaded portion 412 is engaged with the connection rings 31. The first spring 43 is mounted to the push rod 41 and biased between the second push pieces 30 and the inside of the radial hole 22. The first spring 43 pushes the second push pieces 30 against the inside of the radial hole 22.

Figure 16:
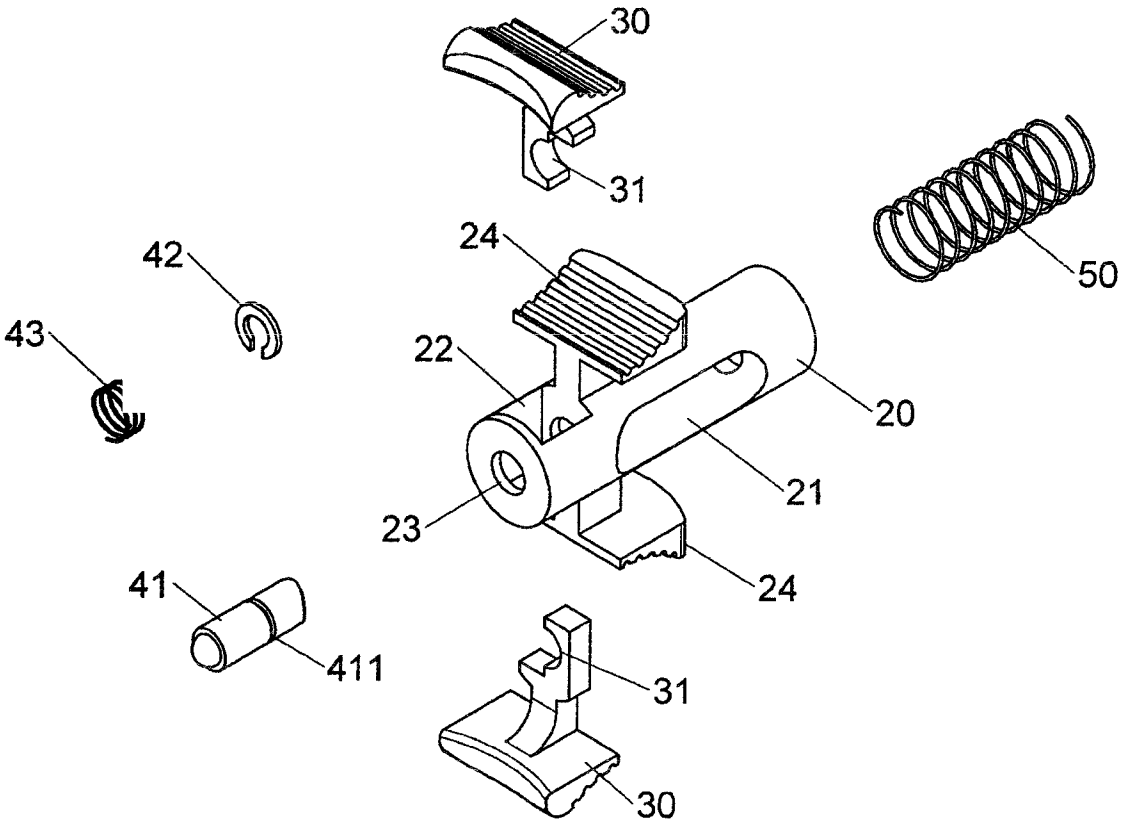
FIG. 16 is an exploded view to show the fourth embodiment of the wrench of the present invention.

FIG. 16 shows that the two connection rings 31 of the two second push pieces 30 are symmetrically located on two sides and the second push pieces 30 cab control the push rod 41 to move forward.

Figure 17:
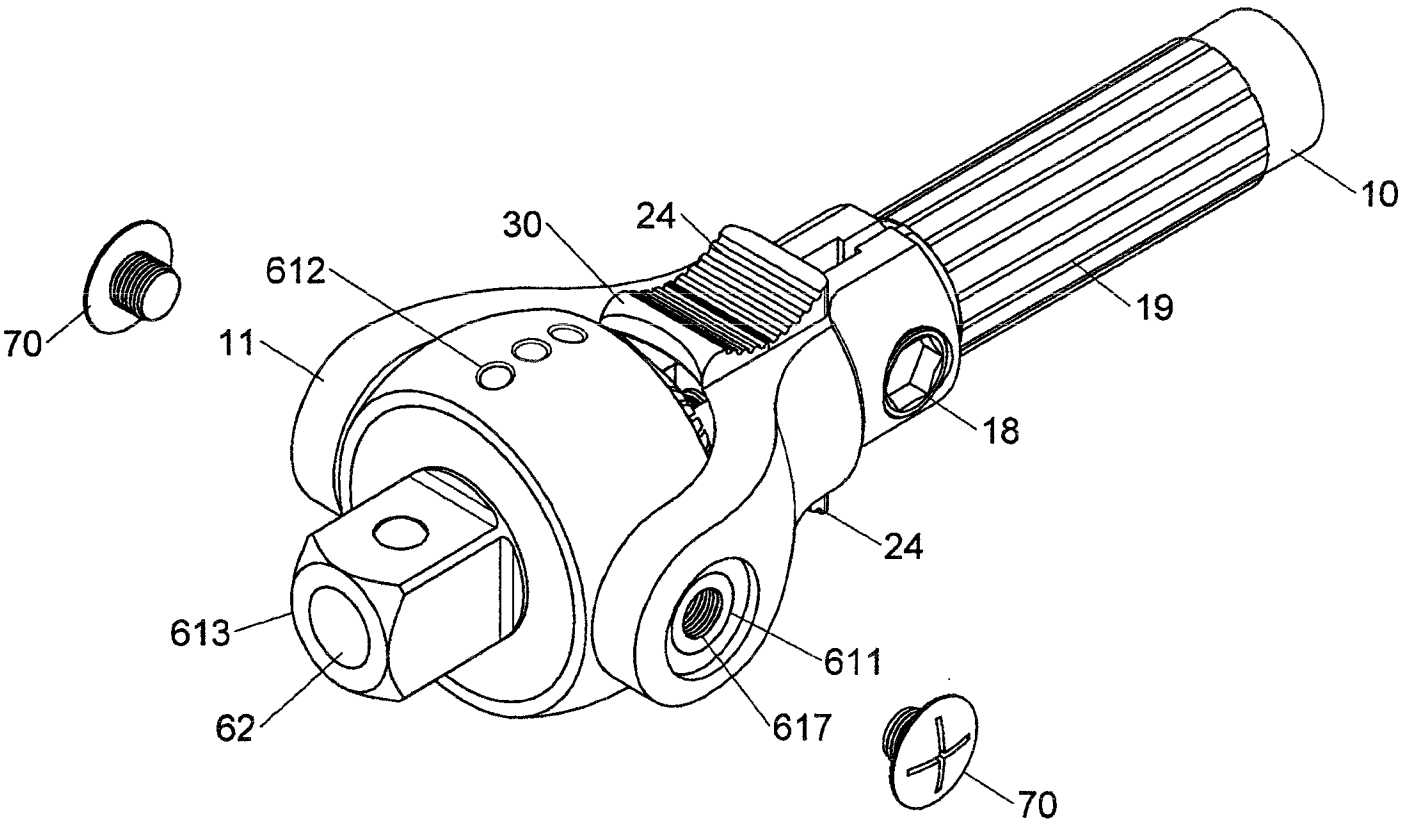
FIG. 17 is an exploded view to show the fifth embodiment of the wrench of the present invention.

FIG. 17 shows that the driving head 60 has a second threaded portion 617 which has inner threads and two fastening members 70 which have outer threads. The fastening members 70 are connected with h the second threaded portion 617.

Figure 18:
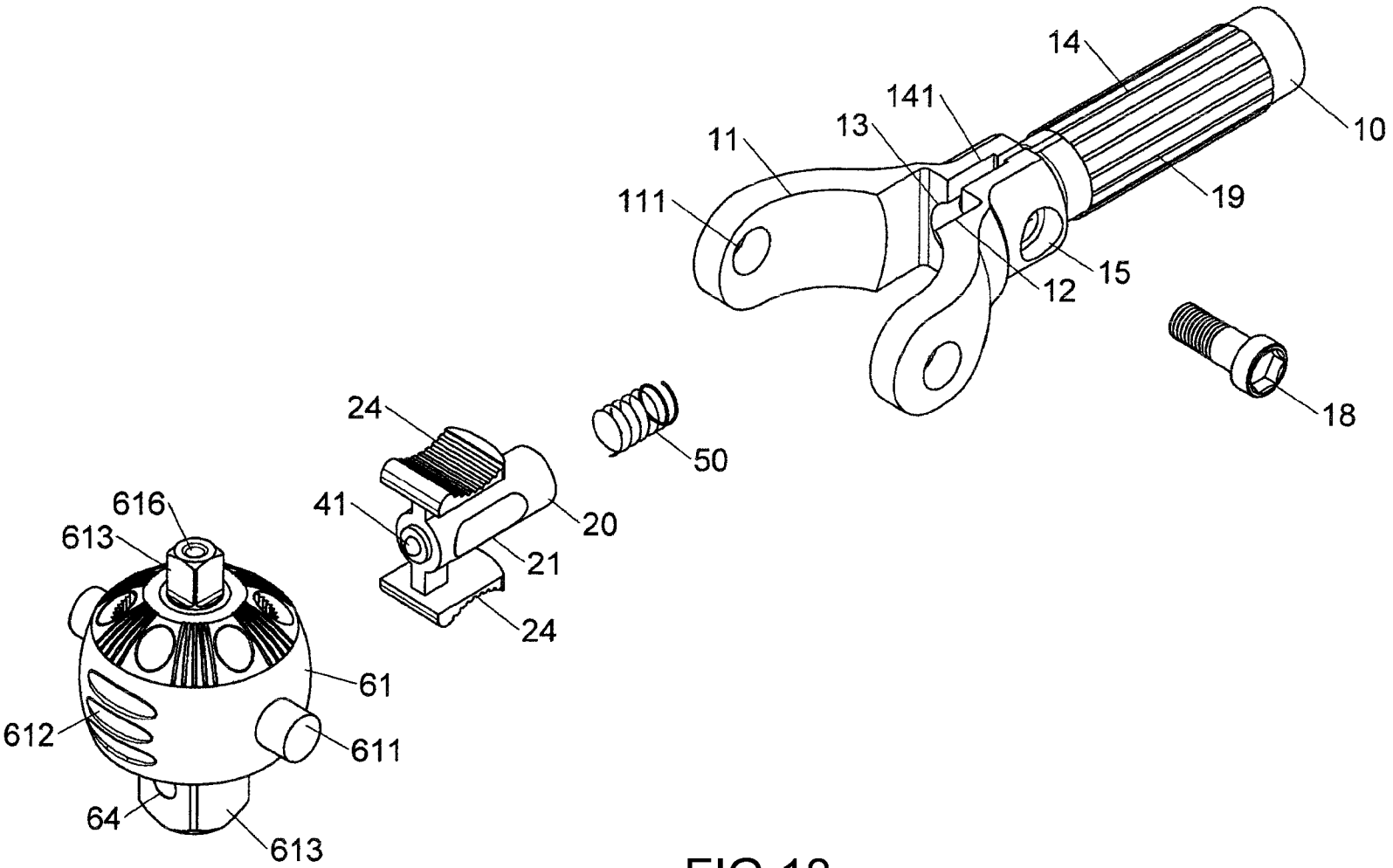
FIG. 18 is an exploded view to show the sixth embodiment of the wrench of the present invention.

FIG. 18 shows that the driving head 60 includes two engaging protrusions 613 on two opposite ends thereof and the two engaging protrusions 613 are two rectangular protrusions of different sizes. The engaging protrusions 613 have a third positioning portion 616 at the distal end thereof. The function of the third positioning portion 616 is the same as that of the positioning holes 612 or the notch 621, and the push rod 41 is engaged with the third positioning portion 616.

Figure 19:
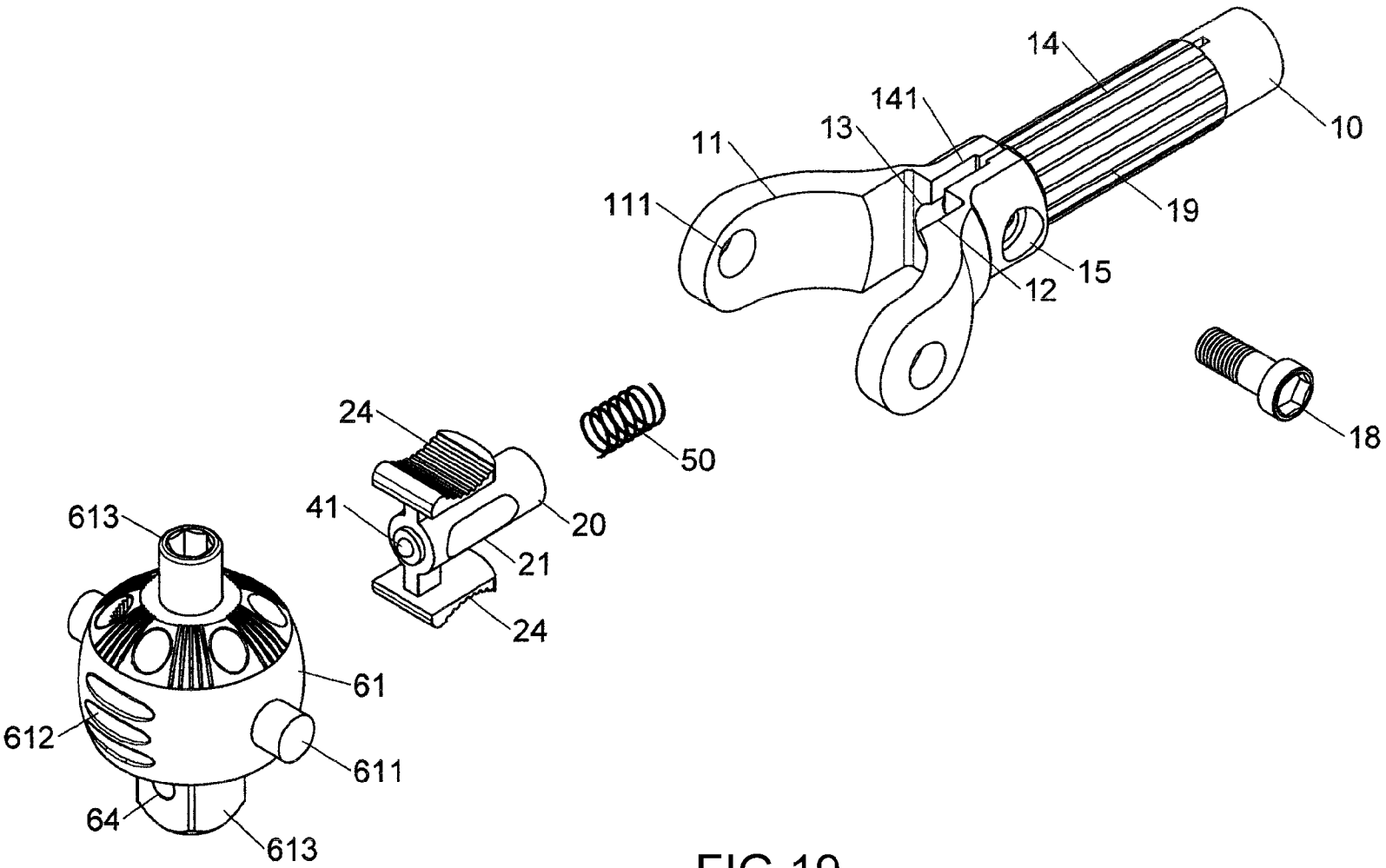
FIG. 19 is an exploded view to show the seventh embodiment of the wrench of the present invention.

As shown in FIG. 19, the driving head 60 includes two engaging protrusions 613 on two opposite ends thereof and one of the engaging protrusions 613 is a rectangular protrusion which has a third positioning portion 616 at the distal end thereof and the push rod 41 is engaged with the third positioning portion 616. The other engaging protrusion 613 has a hexagonal recess for receiving a bit. The push rod 41 is engaged with the hexagonal recess.

The driving head 20 is rotated 360 degrees by pushing the push member 20 toward the handle of the body for a significant distance. When the push unit 40 is moved toward the Y-shaped arm 11, the driving head 60 can be separated from the socket. When the push member 20 is pushed toward the handle for a small distance, the push rod 41 is disengaged from the notch 621 and the driving head 60 can be rotated to a desired position and secured, so that the driving head has multiple operational positions. The push member 20 can be adjusted to three different operation modes. The push member 20, the second push pieces 30, the push unit 40 and the spring member 50 are connected to each other, and then installed to the body 10 to conveniently assemble the wrench. When the push member 20 and the second push pieces 30 are stationary, the recessed area 12 is sealed. The sleeve 19 is mounted to the handle to have aesthetic outer appearance.

While we have shown and described the embodiment in accordance with the present invention, it should be clear to those skilled in the art that further embodiments may be made without departing from the scope of the present invention.

What is claimed is:

1. A wrench comprising:

a body having a Y-shaped arm connected to a first end thereof and a handle extending from a second end of the body, a recessed area defined in an inner end of the Y-shaped arm and a recess defined in an inner end of the recessed area, a slit defined in the body and communicating with and a slot defined in the handle and coaxially communicating with the slit, a width of the slit being larger than that of the slot, a locking hole defined transversely through the body and communicating with the recess;

a push member located in the recess and having a guide hole defined in a mediate portion thereof, the push member having an axial hole defined in a first end thereof and a radial hole defined in an outer surface of the push member and located close to the first end, the guide hole located corresponding to the locking hole and the radial hole located corresponding to the slot, the axial hole communicating with the radial hole and the guide hole, a second end of the push member inserted into the axial hole, the push member having two first push pieces and each first push piece having an extension inserted into the slit and a distal portion extending out from the slit;

two second push pieces located corresponding to the two first push pieces, each second push piece having a connection ring inserted into the radial hole;

a push unit having a push rod located in the axial hole and the an end of the push rod extending out from the axial hole and through the two respective connection rings to position the second push pieces in the radial hole, when the two second push pieces are moved in the radial hole, the push rod moves in the axial hole;

a spring member located in the recess and providing a force to move the push member toward the first end of the body, when the second push pieces are moved toward the second end of the body, the push member compresses the spring member and the push member is moved to open the recessed area;

a positioning pin extending through the locking hole and the guide hole to restrict the push rod to be moved within the recess;

a sleeve mounted to the handle to seal the slot, and a driving head pivotably connected to the Y-shaped arm by two pivots and multiple positioning holes defined in an outer surface of the driving head, at least one engaging protrusion extending from at least one end of driving head, each positioning hole having an axis that extends toward an axes of the pivots, the push rod being engaged with one of the positioning holes, the engaging protrusion having a through hole defined axially therethrough and a reception hole defined radially in the driving engaging protrusion and communicating with the through hole, a bead engaged with the reception hole, a control rod located in the through hole and having a stepped recess defined radially in a first end thereof, the stepped recess located corresponding to the reception hole of the engaging protrusion, a notch defined in a second end of the control rod and the push rod engaged with the notch, a second spring mounted to the control rod to provide a force to move the control rod in the through hole, the bead engaged with the stepped recess and movable within the reception hole along with a movement of the control rod.

2. The wrench as claimed in claim 1, wherein push rod has an annular groove defined in an outer surface thereof and a clip is engaged with the annular groove, an outer diameter of the clip is larger than a diameter of the axial hole of the push member to restrict the push rod from dropping from the axial hole, the clip contacts the second push pieces, a first spring is mounted the push rod and biased between the clip and an inside of the radial hole, when the two second push pieces are moved to compress the first spring, the second push pieces move the push rod which moves in a direction away from the axial hole.

3. The wrench as claimed in claim 1, wherein the connection rings has inner threads and the push rod has a first threaded portion with outer threads, the first threaded portion is engaged with the connection rings, a first spring is mounted to the push rod and biased between the second push pieces and an inside of the radial hole, the first spring pushes the second push pieces against the inside of the radial hole, when the second push pieces are moved to compress the first spring, the second push pieces push the push rod which moves in a direction away from the axial hole.

4. The wrench as claimed in claim 1, wherein two open ends of the through hole are larger than a mediate portion of the through hole, the control rod is a cylindrical rod with two sections of different diameters, a stepped recess is defined in the section with larger diameter and located corresponding to the reception hole.

5. The wrench as claimed in claim 1, wherein first push pieces or the second push pieces are moved toward the second end of the body to move the push rod to compress the spring member, so that the push rod is removed from the notch.

6. The wrench as claimed in claim 1, wherein the positioning pin includes outer threads and threadedly connected to the locking hole and extends through the guide hole.

7. The wrench as claimed in claim 1, wherein the driving head has a second threaded portion which has inner threads and the pivots include outer threads which are engaged with the inner threads of the second threaded portion.

8. The wrench as claimed in claim 1, wherein the driving head includes two engaging protrusions on two opposite ends thereof and at least one of the engaging protrusions has a third positioning portion and the push rod is engaged with the third positioning portion.

9. The wrench as claimed in claim 1, wherein the driving head includes two engaging protrusions on two opposite ends thereof and one of the engaging protrusions is a rectangular protrusion which has a notch, the push rod is engaged with the notch, the other engaging protrusion has a hexagonal recess and the push rod is engaged with the hexagonal recess.

* * * * *